US008893876B2

(12) United States Patent
Morisod et al.

(10) Patent No.: US 8,893,876 B2
(45) Date of Patent: Nov. 25, 2014

(54) UNIT FOR FORMING A LAYER OF FLAT SUPPORTS FOR A MACHINE THAT PRODUCES PACKAGING

(75) Inventors: Jean-Bernard Morisod, Villars-Ste-Croix (CH); José-Manuel Romero, Bussigny (CH)

(73) Assignee: Bobst Mex SA (CH)

( * ) Notice: Subject to any disclaimer, the term of this patent is extended or adjusted under 35 U.S.C. 154(b) by 10 days.

(21) Appl. No.: 13/695,393

(22) PCT Filed: Apr. 1, 2011

(86) PCT No.: PCT/EP2011/001653
§ 371 (c)(1), (2), (4) Date: Oct. 30, 2012

(87) PCT Pub. No.: WO2011/134583
PCT Pub. Date: Nov. 3, 2011

(65) Prior Publication Data
US 2013/0043105 A1 Feb. 21, 2013

(30) Foreign Application Priority Data
Apr. 30, 2010 (EP) ..... 10004579

(51) Int. Cl.
*B65H 29/66* (2006.01)

(52) U.S. Cl.
CPC .... *B65H 29/6618* (2013.01); *B65H 2404/2532* (2013.01); *B65H 2301/151* (2013.01)
USPC ..... 198/462.3; 198/431; 198/577; 198/578; 198/579; 198/459.1; 198/461.1; 198/462.1

(58) Field of Classification Search
USPC ..... 198/457.02, 457.03, 459.1, 459.8, 198/461.1, 461.3, 462.1, 462.3, 601, 589, 198/592, 462.2, 418.9, 419.2, 431, 560, 198/577, 578, 579
See application file for complete search history.

(56) References Cited

U.S. PATENT DOCUMENTS 2,526,726 A 10/1950 Brown ..... 74/471 R
2,852,256 A 9/1955 Faults, Jr. et al. ..... 271/197

(Continued)

FOREIGN PATENT DOCUMENTS

CH 363666 8/1962
DE 3409548 10/1984

(Continued)

OTHER PUBLICATIONS

International Search Report dated May 19, 2011 (previously submitted to the U.S. Patent Office on Oct. 5, 2012).

*Primary Examiner* — Leslie A Nicholson, III
(74) *Attorney, Agent, or Firm* — Ostrolenk Faber LLP

(57) ABSTRACT

A unit for forming one or more layers of individual flat supports, taken from at least a first conveyor device, conveying the supports from upstream to downstream at a first speed, that includes a second conveyor device, conveying the supports from upstream to downstream at a second speed lower than the first speed, positioned downstream of the first conveyor device, equipped with a receiving zone for receiving the supports arriving from the first conveyor device, and having a curved portion, and means for forming the layer positioned above the second conveyor device, situated downstream of the curved portion, and driven at the second speed.

10 Claims, 2 Drawing Sheets

(56) References Cited

U.S. PATENT DOCUMENTS

| | | | | |
|---|---|---|---|---|
| 3,315,956 | A | 6/1964 | Lyman | 271/258.01 |
| 3,861,515 | A | 1/1975 | Runyan et al. | 198/34 |
| 3,942,786 | A | 3/1976 | Lauren | 271/177 |
| 4,265,443 | A * | 5/1981 | Berthelot | 271/182 |
| 4,548,404 | A * | 10/1985 | Brandt et al. | 271/303 |
| 6,398,010 | B1 * | 6/2002 | Fangmeier | 198/462.2 |
| 6,619,017 | B2 * | 9/2003 | Franzaroli | 53/435 |
| 7,556,247 | B1 * | 7/2009 | Delfer et al. | 270/21.1 |
| 7,918,443 | B2 * | 4/2011 | Fokos | 270/52.19 |

FOREIGN PATENT DOCUMENTS

| | | |
|---|---|---|
| EP | 1 431 049 | 6/2004 |
| FR | 2 784 085 | 4/2000 |
| JP | 63-267658 A | 11/1988 |
| JP | 8-113405 | 5/1996 |

* cited by examiner

UNIT FOR FORMING A LAYER OF FLAT SUPPORTS FOR A MACHINE THAT PRODUCES PACKAGING

CROSS-REFERENCE TO RELATED APPLICATIONS

The present application is a 35 U.S.C. §§371 national phase conversion of PCT/EP2011/001653, filed Apr. 1, 2011, which claims priority of European Application No. 10004579.8, filed Apr. 30, 2010, the contents of which are incorporated herein by reference. The PCT International Application was published in the French language.

BACKGROUND OF THE INVENTION

1. Field of the Invention

The present invention relates to a unit intended to form one or more layers from individual flat supports or substrates. The invention also relates to a machine for producing packaging comprising such a unit for forming this or these layers.

2. Description of the Related Art

In a machine for producing packaging, an initial flat printing substrate, such as a continuous strip of cardboard, is successively unwound, printed and cut to a given shape. Each of the cutouts or boxes obtained is intended to form an item of packaging once it has been folded and glued. To make the packaging easier to assemble, the cutouts often have flaps extending from each of their sides and scoring to make the sides of the packaging easier to fold.

Once these cutouts have been produced, the initial substrate is then conveyed through a separation unit so as to position the various cutouts in several adjacent parallel lines. The separation unit causes the cutouts to deviate slightly from the initial longitudinal direction. It is possible afterwards to realign each of the cutouts in the same main direction using one or more alignment modules located downstream of the separator. This alignment module generally takes the form of two conveyor belts facing one another and one above the other. Each of the cutouts is inserted and moved at high speed between the two belts. The alignment modules, and therefore the cutouts, are distant from one another.

The next step is then to route each of these cutouts to the stacking station. However, the cutouts can be stacked and bundled correctly only if the cutouts are moving slowly. It is necessary to reduce the speed of the cutouts as they leave the alignment module. This slowing is generally achieved by transferring the cutouts onto a conveyor device situated downstream of the alignment module, the conveyor device moving at a lower speed by comparison with that of the conveyor device formed by the alignment module.

In order to reduce the length of the stacking and bundling unit and thus of the machine, it proves necessary to create a layer of cutouts. Thus, as many lines of layers are formed as there are cutouts across the width of the initial substrate. The cutouts are laid on one another with overlap as the flow of cutouts progresses. This arrangement and this progression of the cutouts in layer form also make it possible to maintain a constant rate of production.

The layer is formed by a transfer and by a speed differential between a first conveyor device, that conveys the cutouts quickly, and a second conveyor device that conveys the layer more slowly (see, for example, documents U.S. Pat. No. 3,942,786 and FR 2 784 085). The first conveyor device is either the alignment module or ramps of the separation unit.

Problems with recurrent jams have been noted in this transfer region. These jams are often caused by the difficulty in setting down a cutout that is moving at high speed and relatively freely on to a layer of cutouts that has already been formed and is moving more slowly. The speed differential between the rapidly-moving cutout and the slow-moving layer may notably result in incorrect orientation of the cutout once it has been set down on the layer. If this is not detected and corrected in time, this incorrect orientation may then in turn impede the setting-down of the next cutouts.

In many cases, one cutout becomes caught or even wedged in another, notably at their flaps, tabs, rim edges, cutouts, embossing or any other modifications. This wedging therefore causes jams which force the operator regularly to shut down the unit so that the normal flow of cutouts can be re-established.

This difficulty in correctly positioning the cutouts leaving the first conveyor device is also exacerbated by the way in which the cutouts behave while they are being transferred to the slow-moving second conveyor device. The second conveyor device is generally situated lower down than the exit from the first conveyor device, i.e. the alignment module. The cutouts are released from this exit before they reach the slow-moving conveyor device. As they fall, they are therefore subjected to the air currents generated by the conveyor devices or by the cutouts themselves. Their small thickness and relative lightness of weight therefore cause them to oscillate about an ideal path. It is therefore often difficult to control the path followed by the cutouts while they are being transferred at the instant that they arrive in the unit that forms them into a layer.

One first system for controlling the path of the cutouts is to insert a plurality of deflectors between the exit from the first conveyor device and the entrance to the second conveyor device. However, even though these deflectors appreciably reduce the risk of jams at relatively slow speeds, they prove to be insufficient when the cutouts are moving very quickly. In that case, the air currents generated within the machine have far too disturbing an influence on the path of the cutouts for the deflectors really to be able to confer an ideal path on the cutouts. Moreover, even at slow speeds, it is often necessary regularly and individually to readjust each of the deflectors in order to guarantee uniformity in the flow of the cutouts.

To supplement these deflectors, use is also made of press rollers positioned transversely to the slow-moving conveyor device in order to press firmly on the top of the lines of layers of cutouts. These press rollers are generally positioned just after the deflectors so as to press the cutouts leaving the first conveyor device firmly against the layer that is in the process of forming. These rollers therefore contribute to decelerating the cutouts from a high speed to a slow speed. However, these rollers prove to be incapable of limiting the risk of the cutouts becoming wedged in one another, notably at their respective flaps.

In the devices of the related art, the position of a substrate in the layer fluctuates further in the first few moments following its introduction to the layer because its speed has not yet become stabilized. It therefore has a tendency to slip on the substrate preceding it. This slippage further increases the risk of these substrates becoming wedged together and, therefore, of causing a jam in the unit.

SUMMARY OF THE INVENTION

A main objective of the present invention is to develop a unit for forming one or more layers of individual flat substrates. A second objective is to create a layering unit that allows effective control over the path of the cutouts. A third objective is to make the layering accurate by avoiding the cutouts becoming wedged in one another. A fourth objective is that of obtaining a layering unit that makes it possible to avoid the disadvantages of the related art. Yet another objective is that of providing a machine for producing packaging having a separation unit and a layering unit.

A unit for forming one or more layers of individual flat substrates, arriving from at least one first conveyor device, conveying the substrates from upstream to downstream at a first speed, comprises:

a second conveyor device, conveying the substrates from upstream to downstream at a second speed lower than the first speed, positioned downstream of the first conveyor device, equipped with a receiving zone for the substrates arriving from the first conveyor device, and having a curved portion, and layer-forming means, positioned above the second conveyor device, and driven at the second speed.

According to one aspect of the present invention, the unit is characterized in that the layer-forming means are situated downstream of the curved portion.

In other words, with the invention, the curved portion is used to curve an upstream individual flat substrate and position it on a preceding downstream individual flat substrate prior to the definitive layering. The unit is configured to curve the individual flat substrates after they have arrived one after another at the moment that they enter the curved portion and set them down on the substrates already set down on the second conveyor device. It is not until after this curving phase that the layer is formed by the means that form the layer.

On the one hand, this curving gives the substrate a bowed shape which is better suited to accepting the substrates that follow upstream arriving from the first conveyor device and which are set down at high speed on the second conveyor device. The substrates set down travel over the upwardly facing curved surface of the curved portion. The substrates that are set down on the substrates already set down are conveyed and guided more effectively than if they had been set down on a flat surface. Moreover, the curved shape also prevents flaps, tab, rim edges, cut lines, embossing or any other modifications of the substrate already set down from impeding the setting-down of the next substrates. These flaps, tabs, rim edges, cut lines, embossings or any other modifications must not interfere with the flaps, tabs, rim edges, cut lines, embossings or any other modifications of the next substrates and vice versa. With the invention, the risk of a substrate becoming wedged in one of these flaps, tabs, rim edges, cut lines, embossings or any other modifications has therefore become far lower, prior to layering.

Curving of the substrates also makes it easier for the substrates to be layered on the second conveyor device. Specifically, once the curved portion has been negotiated, the bowed substrate returns to the substrate preceding it in the layer that is forming. Its position in relation to this previous substrate does not change until the stacking step.

In another aspect of the invention, a machine for producing packaging is characterized in that it comprises the unit for forming one or more layers that has one or more of the technical features described hereinbelow and claimed, situated downstream of a unit for separating the flat substrates.

The upstream and downstream directions are defined with reference to the direction of travel of the substrates, in the longitudinal direction of the unit that forms the layer and through the packaging production machine as a whole. The longitudinal direction is defined with reference to the direction of travel of the substrates through the unit that forms the layer and through the machine, along the median longitudinal axis thereof. The transverse direction is defined as being the direction perpendicular to the direction of travel of the substrates.

BRIEF DESCRIPTION OF THE DRAWINGS

Other advantages and features of the present invention will be better understood from reading the nonlimiting embodiments of the invention and from studying the drawings in which.

DETAILED DESCRIPTION OF THE PREFERRED EMBODIMENTS

Figure 1:
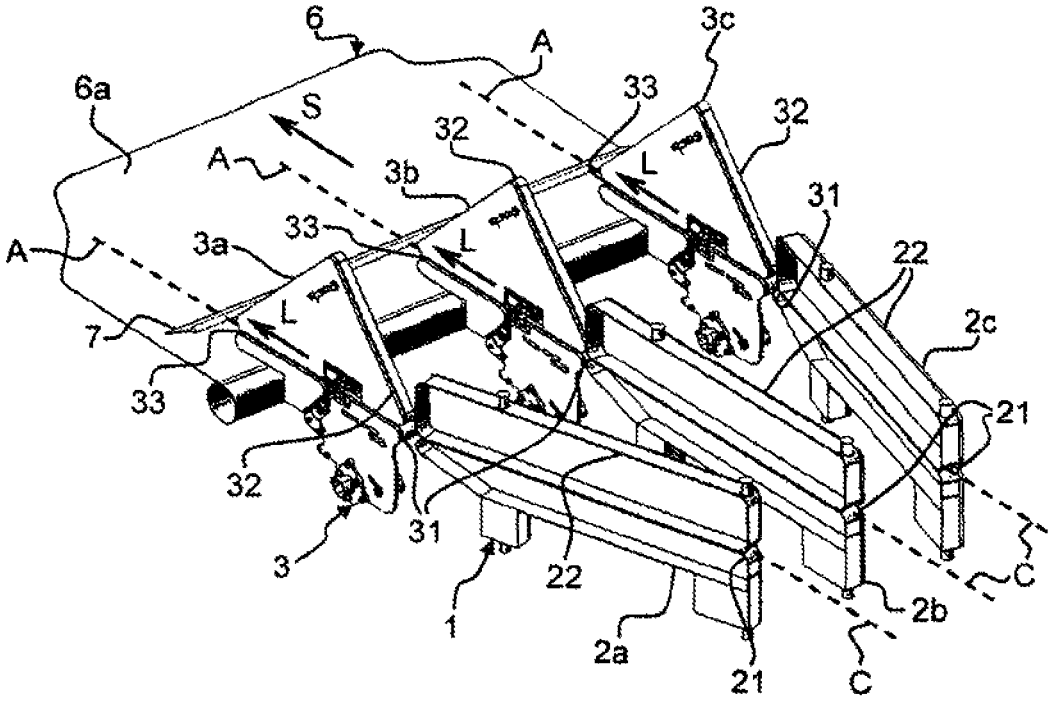
FIG. 1 is a perspective view of a separation unit installed upstream of a layering unit according to the invention.

In a machine (not depicted) for producing packaging, a continuous strip of cardboard is printed in a printing unit then cut in a cutting unit. As can be seen in FIG. 1, this cutting is done for example to form three initial lines or lanes C of identical individual flat cardboard substrates or cutouts 10 which are distributed uniformly across its width.

Figure 2:
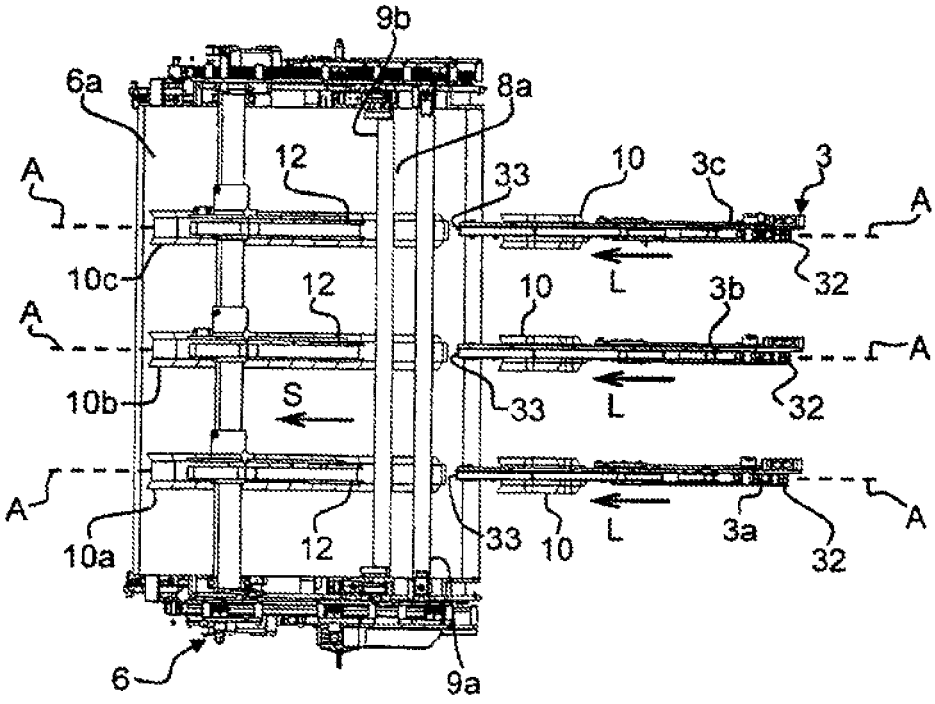
FIG. 2 is a view of the layering unit from above.

A separation unit 1 is arranged at the exit of the cutting unit (see FIGS. 1 and 2). The separation unit 1 allows each of the cutouts arriving in the three initial lines C to be separated into three lines or lanes which are very distinct and transversely separated A. In this particular instance, the separation unit 1 thus consists of three separating conveying ramps 2*a*, 2*b* and 2*c* in a fantail configuration. Two of the lateral separating conveying ramps 2*a* and 2*c* are arranged one on either side of the central separating conveying ramp 2*b*. The fantail configuration allows the lines A of cutouts 10 to be separated transversely from one another.

Each of the separating conveying ramps 2*a*, 2*b* and 2*c* comprises a motor-driven lower endless belt 21 and a motor-driven upper endless belt 22. The cutouts 10 are held between the lower belt 21 and the upper belt 22 and are driven along by these two, lower 21 and upper 22, belts.

During this separation phase, the cutouts 10 positioned in adjacent lines C are separated to give three continuous streams A of cutouts 10. The cutouts 10 are also evenly spaced longitudinally from one another and travel at high speed within these streams.

At the exit from the separation unit 1, the path of the cutouts 10 that have moved along the lateral separating conveying ramps 2*a* and 2*c* positioned at an angle to the central separating ramp 2*b* is realigned along longitudinal axes. To achieve this alignment, the machine for producing packaging comprises an alignment module which constitutes a first conveyor device 3 for subsequent layering. In this example in which there are three separating conveying ramps 2*a*, 2*b* and 2*c* for the separation unit 1, the first conveyor device 3 is equipped with an equivalent number of conveyor ramps, i.e. with three conveyor ramps 3*a*, 3*b* and 3*c*. The first conveyor device 3 is intended to accept each of the cutouts 10 arriving from the separating ramps and cause it to move and/or to pivot so as to orient and align it in a single longitudinal direction. Each of the conveyor ramps 3*a*, 3*b* and 3*c* is situated facing each of the separating conveying ramps 2*a*, 2*b* and 2*c*. In the case depicted in FIGS. 1 and 2, this direction corresponds more or less to the direction of the central conveying ramp 2*b*. The three conveyor ramps 3*a*, 3*b* and 3*c* are mutually parallel and parallel to the longitudinal axis of the machine.

Figure 3:
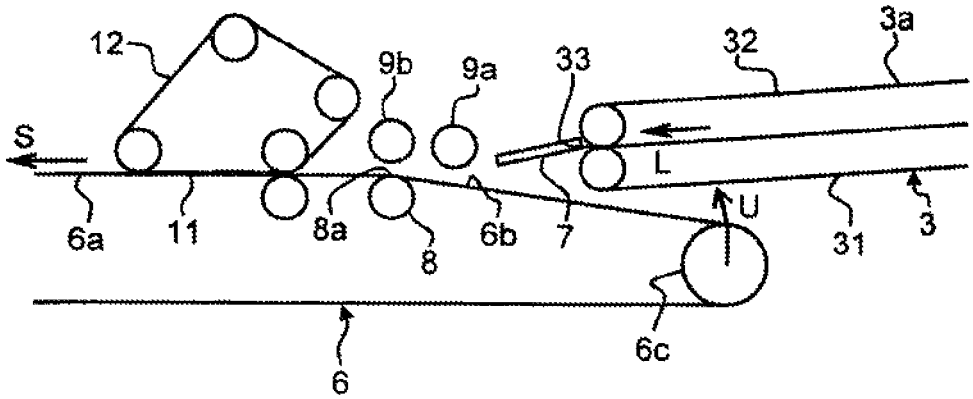
FIG. 3 is a side view of the unit of FIG. 2, in a first configuration of the invention.
Figure 4:
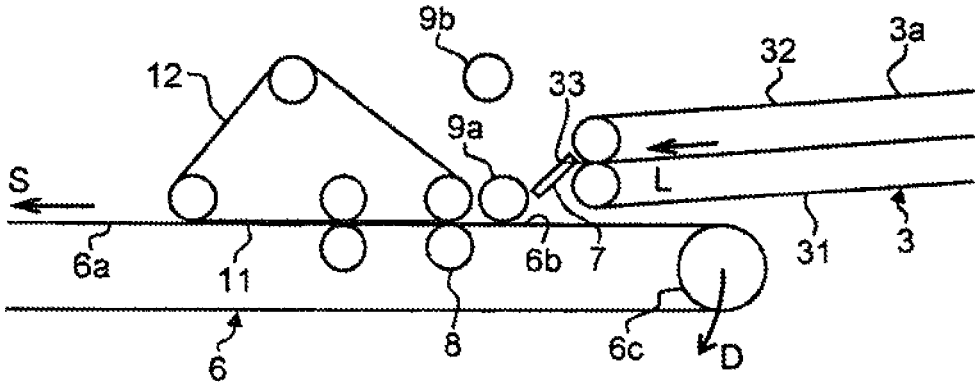
FIG. 4 is a side view of the unit of FIG. 2, in a second configuration of the invention.

Each of the conveyor ramps 3*a*, 3*b* and 3*c* comprises a motor-driven lower endless conveyor belt 31 and a motor-driven upper endless conveyor belt 32 (see FIGS. 1, 3 and 4). The cutouts 10 are held between the lower belt 31 and the upper belt 32 and driven along by these two, lower 31 and upper 32, belts. Each of the conveyor ramps 3*a*, 3*b* and 3*c* causes the cutouts 10 to travel at a first given speed from upstream to downstream (arrow L in FIGS. 1 to 4).

The cutouts 10 leave the conveyor ramps 3*a*, 3*b* and 3*c* via a distribution end 33. The distribution end 33 is the downstream limit of the nip between the lower conveyor belt 31 and the upper conveyor belt 32.

The machine comprises a unit that layers or that forms one or more layers with the cutouts 10. The layering unit 6 is situated downstream of the first conveyor device 3 and therefore downstream of the separation unit 1. The layering unit 6 is supplied with cutouts 10 by each of the conveyor ramps 3*a*, 3*b* and 3*c* of the first conveyor device 3, the latter therefore being inserted between the separation unit 1 and the layering unit 6.

The layering unit 6 could equally well operate without the presence of a first conveyor device 3. In that case, the separating conveying ramps 2*a*, 2*b* and 2*c* of the separation unit 1 may act as first conveyor device moving along at the first given speed.

The layering unit 6 comprises a second conveyor device 6*a* conveying the cutouts 10 from upstream to downstream. This second conveyor device 6*a* takes the form of an endless conveyor belt, of which the upper surface supporting the cutouts advances from upstream to downstream (arrow S in FIGS. 1 to 4).

The second conveyor device 6*a* is equipped with a receiving zone 6*b* at the upper surface of the endless conveyor belt. Each of the cutouts 10 is set down on the second conveyor device 6*a* in the receiving zone 6*b*. The receiving zone 6*b* for example receives the front of the next cutout in the middle of the preceding cutout already set down.

This conveyor belt 6*a* moves at a second speed that is lower in comparison with the first speed of each of the conveyor ramps 3*a*, 3*b* and 3*c* of the first conveyor device 3. Each one of the distribution ends 33 of the conveyor ramps 3*a*, 3*b* and 3*c* is positioned upstream and above the conveyor belt 6*a*.

Advantageously, a single deflector 7 is situated between the conveyor ramps 3*a*, 3*b* and 3*c* and the conveyor belt 6*a*. This deflector 7 takes the form of an elongate plate. This plate 7 extends substantially across the entire width of the conveyor belt 6*a*. This plate 7 is situated above the conveyor belt 6*a*. This plate 7 is oriented obliquely in relation to the plane formed by the conveyor belt 6*a*. The upstream upper edge of the plate 7 is positioned near the distribution end 33 of each of the conveyor ramps 3*a*, 3*b* and 3*c*. The downstream lower edge of the plate 7 is slightly raised in relation to the second conveyor belt 6*a*.

The deflector 7 is configured to direct the cutouts 10 from the first conveyor device 3 toward the second conveyor device 6. The deflector 7 allows almost identical paths to be impressed on the cutouts 10 leaving the distribution end 33.

Having a single deflector 7 for all of the lines of layer makes it possible to avoid the problems of painstaking and repeated adjustments that operators have to perform. Of course, this single deflector 7 could if necessary be replaced by several deflectors distributed uniformly across the entire width of the conveyor belt 6*a* and situated at the exit of each of the distribution ends 33 of the conveyor ramps 3*a*, 3*b* and 3*c*.

Three parallel layers 10*a*, 10*b* and 10*c* are formed on the conveyor belt 6*a* by the cutouts 10 leaving the conveyor ramps 3*a*, 3*b* and 3*c* one after another (see FIG. 2) in three clearly distinct lines or lanes A. The layers 10*a*, 10*b* and 10*c* are obtained as a result of the difference in speed between the conveyor belt 6*a* that causes the layers 10*a*, 10*b* and 10*c* to progress slowly and the conveyor ramps 3*a*, 3*b* and 3*c* that carry the cutouts 10 quickly.

The layering unit 6 comprises an intermediate roller 8 situated under the conveyor belt 6*a* level with its upper part. The intermediate roller 8 turns at a speed substantially equal to that of the conveyor belt 6*a*.

The layering unit 6 comprises an upstream roller 6*c* that returns the end of the conveyor belt 6*a*. The upstream roller 6*c* is able to move up (arrows U in FIG. 3) or down (arrow D in FIG. 4), to move from a lowered position into a raised position and, conversely, from a raised position into a lowered position. When the upstream roller 6*c* is in the lowered position (see FIG. 3), the layering unit 6 is in a first configuration according to the invention. When the upstream roller 6*c* is in the raised position (see FIG. 4), the layering unit 6 is in a second configuration according to the invention.

In the first configuration (FIG. 3), the upper part of the conveyor belt 6*a* progresses from an upwardly inclined part situated upstream to a horizontal part situated downstream, because of the lowered position of the upstream roller 6*c*. With the upstream roller 6*c* in this position, the roller 8 forms at the surface of the conveyor belt 6*a* a convex curved portion 8*a* similar to a bump or surface oriented and bulging upward. This portion 8*a* forms an inflexion. This bump 8*a* runs transversely across the entire width of the conveyor belt 6*a*.

This bump 8*a* is able to lift the cutouts 10 as they travel along the conveyor belt 6*a* and to curve a downstream cutout, preparing it for the positioning of the upstream cutout that is to follow. The bump 8*a* is situated downstream of the receiving zone 6*b* on the second conveyor device 6*a*. This position of the bump 8*a* separate from the receiving zone 6*b* means that a cutout 10 can be received unimpeded on a cutout that has already been set down and curved. This makes it possible to prevent the cutout received at the receiving zone 6*b* from interfering with the modifications, for example flaps, tabs, rim edges, cutting lines, embossings, of the cutout already set down.

In order to make it easier for the cutouts 10 to negotiate the bump 8*a*, transfer devices in the form of rollers 9*a* and 9*b* are advantageously situated above the conveyor belt 6*a* and a short distance therefrom. These transfer rollers 9*a* and 9*b* are rotationally driven, their rotational speed being lower than or substantially equal to the speed of travel of the first conveyor device 3 of the alignment module.

The first of these transfer devices, the upstream roller 9*a*, is positioned between the deflector 7 and the intermediate roller 8, i.e. between the bump 8*a* and the first conveyor device 3 and above the second conveyor device 6, so as to transfer the cutouts 10, to accompany them along their path, and to slow them.

The second of these transfer devices, the downstream roller 9*b*, is positioned above the second conveyor device 6, substantially plumb with the bump 8*a*, i.e. with the intermediate roller 8, so as to transfer the cutouts 10, accompany them along their path, and slow them.

During the formation of the layer 10*a*, 10*b*, and 10*c*, these transfer rollers 9*a* and 9*b* accompany the cutouts 10 and direct them by impressing a path upon them before these cutouts 10 are definitively set down on the conveyor belt 6*a*. This prevents the cutouts 10 from being subjected to significant torsional or stretching forces and thus avoids creasing or offset with respect to the main direction defined by the layer 10*a*, 10*b* and 10*c*. Because the transfer rollers 9*a* and 9*b* have a circumferential speed that is not as high as the speed at which the cutouts 10 are progressing, they progressively slow the cutouts 10 just before the layer 10*a*, 10*b* and 10*c* is formed.

This first configuration with a bump 8*a* and two transfer rollers 9*a* and 9*b* is more specifically intended for layering cutouts 10 of the "long grain" type or type that has an elongate shape and is arranged in the longitudinal direction.

In this first configuration, the longitudinal position of the upstream roller 9*a* is set so that the distance between the distribution end 33 and the point on the conveyor belt 6*a* vertically in line with this upstream roller 9*a* corresponds to the dimension of the cutout 10, considered in the longitudinal direction. With this setting, a rear zone of the cutout 10 is released by the distribution end 33 only when a front zone of the cutout 10 comes into contact with the upstream roller 9*a* and/or with the conveyor belt 6*a*. The path of the cutout 10 thus remains constantly under control.

In the second configuration (FIG. 4), the upper part of the conveyor belt 6*a* remains horizontal, because of the raised position of the upstream roller 6*c*. The intermediate roller 8 remains positioned below the surface of the conveyor belt 6*a*. With the upstream roller 6*c* in this position, the conveyor belt 6*a* has no convex curved portion similar to bump or upwardly bulging surface 8*a*.

To improve the layering 10*a*, 10*b* and 10*c*, the upstream transfer roller 9*a* is positioned on the conveyor belt 6*a* and upstream of the intermediate roller 8. This upstream transfer roller 9*a* is positioned just after the deflector 7 to press against the cutouts 10 newly set down on the conveyor belt 6*a*. The rotational speed of the upstream transfer roller 9*a* is equal to the speed of travel of the conveyor belt 6*a*. The downstream roller 9*b* is retracted upward.

This second configuration with no bump and with a single transfer roller 9*a* is intended more specifically for layering cutouts 10 of the "short grain" type or the type that has an elongate shape and is arranged perpendicular to the longitudinal direction.

It should be noted that the position of the upstream roller 9*a* is shifted upstream, the position of the conveyor belt 6*a* remaining the same. This position makes it possible to reduce the distance between the distribution end 33 and the upstream transfer roller 9*a* with respect to the distance provided in the first configuration. In this second configuration, the longitudinal position of the upstream roller 9*a* is set so that the distance between the distribution end 33 and the point on the conveyor belt 6*a* vertically aligned with this upstream roller 9*a* corresponds to the dimension of the cutout 10, considered in the longitudinal direction. With this setting, an upstream lateral zone of the cutout 10 is released by the distribution end 33 only when a downstream lateral zone comes into contact with the upstream roller 9*a* and/or with the conveyor belt 6*a*. The path of the cutout 10 thus remains constantly under control.

In both the first and the second configuration, the layering unit 6 comprises means for forming the layer or layers 10*a*, 10*b* and 10*c*, in the form of a motorized feed device 12. The motorized feed device 12 is positioned above the second conveyor device 6*a*. The motorized feed device 12 is positioned downstream of the bump 8*a*, in the region of the horizontal part situated downstream of the conveyor belt 6*a*. The motorized feed device 12 comprises an endless conveyor belt situated above the conveyor belt 6*a*. The motorized feed device 12 is driven at substantially the same speed as the second conveyor device 6*a*.

The motorized feed device 12 is used to form and then stabilize the layers of cutouts 10*a*, 10*b* and 10*c*. Each of the lines of layers 10*a*, 10*b* and 10*c* is formed and compressed downstream of the bump 8*a* and of the transfer roller or rollers 9*a* and/or 9*b* in a nip 11 between the conveyor belt 6*a* and the motorized feed device 12.

In the layering unit 6, the receiving zone 6*b* for the cutouts 10 at the conveyor belt 6*a*, the bump 8*a* of the conveyor belt 6*a* and the motorized feed device 12 are separate. This separation of functions, with arrival and receipt of the cutouts 10, curving of the cutouts 10 and layering of the cutouts 10 means that the layering can be optimized. The cutouts 10 follow a path that is controlled and have a speed that is stabilized, thus avoiding the risks of jams.

The present invention is not restricted to the embodiments described and illustrated. Numerous modifications can be made without thereby departing from the context defined by the scope of the set of claims.

The invention claimed is:

1. A unit for forming one or more streams of individual flat substrates, arriving from at least one first conveyor device, conveying the substrates from upstream to downstream at a first speed, comprising:

a second conveyor device, conveying the substrates from upstream to downstream at a second speed lower than the first speed, positioned downstream of the at least one first conveyor device, equipped with a receiving zone for the substrates arriving from the at least one first conveyor device, and having a curved portion, a device that forms the one or more streams, positioned above the second conveyor device, and driven at the second speed, wherein the device that forms the one or more streams is situated downstream of the curved portion, and the substrates leave the at least one first conveyor device downstream of an upstream end of the second conveyor device.

2. The unit as claimed in claim 1, wherein the curved portion is situated downstream of the receiving zone on the second conveyor device.

3. The unit as claimed in claim 1, further comprising a first transfer device, positioned between the curved portion and the at least one first conveyor device and above the second conveyor device.

4. The unit as claimed in claim 3, further comprising a second transfer device positioned substantially plumb with the curved portion and above the second conveyor device.

5. The unit as claimed in claim 1, wherein the curved portion is a convex portion extending over the entire width of the second conveyor device.

6. The unit as claimed in claim 5, wherein the convex portion is formed with an intermediate roller, positioned level with the second conveyor device and rotationally driven.

7. The unit as claimed in claim 6, wherein the first conveyor device comprises at least one ramp with an endless conveyor belt, and the second conveyor device comprises an endless conveyor belt, the intermediate roller being positioned under the endless conveyor belt and rotating at a speed substantially equal to that of said conveyor belt.

8. The unit as claimed in claim 1, wherein the second conveyor device comprises an upstream roller able to move up, and down in order to form the curved portion at the surface of the conveyor belt.

9. The unit as claimed in claim 1, further comprising a deflector configured to direct the substrates from the at least one first conveyor device toward the second conveyor device.

10. A unit for forming one or more streams of individual flat substrates, arriving from at least one first conveyor device, conveying the substrates from upstream to downstream at a first speed, comprising:

a second conveyor device, conveying the substrates from upstream to downstream at a second speed lower than the first speed, positioned downstream of the at least one first conveyor device, equipped with a receiving zone for the substrates arriving from the at least one first conveyor device, and having a curved portion, a device that forms the one or more streams, positioned above the second conveyor device, and driven at the second speed, a first transfer device, positioned between the curved portion and the at least one first conveyor device and above the second conveyor device, and a second transfer device positioned substantially plumb with the curved portion and above the second conveyor device, wherein the device that forms the one or more streams is situated downstream of the curved portion, and the first and second transfer devices are rollers rotationally driven and rotating at a speed less than or substantially equal to that of the at least one first conveyor device, so as to drive and to slow the substrates.

* * * * *